US006478934B2

(12) United States Patent
Oldani et al.

(10) Patent No.: US 6,478,934 B2
(45) Date of Patent: Nov. 12, 2002

(54) MOTORIZED FRAME FOR ADJUSTING THE INTERELECTRODIC GAP IN MERCURY CELLS

(75) Inventors: Dario Oldani, Milan; Salvatore Peragine, Sesto S. Giovanni, both of (IT)

(73) Assignee: De Nora Elettrodi S.p.A., Milan (IT)

( * ) Notice: Subject to any disclaimer, the term of this patent is extended or adjusted under 35 U.S.C. 154(b) by 0 days.

(21) Appl. No.: 09/728,965

(22) Filed: Dec. 4, 2000

(65) Prior Publication Data

US 2002/0008020 A1 Jan. 24, 2002

(30) Foreign Application Priority Data

Jul. 24, 2000 (IT) ..... MI20A1686

(51) Int. Cl.[7] ..... C25D 17/00

(52) U.S. Cl. ..... 204/219; 204/221; 204/225; 204/228.1; 204/230.2; 204/230.3; 204/230.4; 204/250; 204/279; 204/297.01; 204/297.06; 204/297.08

(58) Field of Search ..... 204/250, 279, 204/219, 225, 221, 228.1, 230.2, 230.3, 230.4, 297.01, 297.06, 297.08

(56) References Cited

U.S. PATENT DOCUMENTS 3,616,448 A * 10/1971 Rossi et al. ..... 204/250

* cited by examiner

*Primary Examiner*—Bruce F. Bell

(57) ABSTRACT

The invention concerns a motorized device for adjusting the interelectrodic gap in mercury cathode electrolysis cells, mainly consisting of a frame, to which a number of anodes are suspended, movable in the vertical direction by means of a single jackscrew driven by a gear motor acting on double levers. The jackscrew with the motor and the lever system are fixed to a main frame, supported on the cell bottom by means of supports positioned on adjustable columns, while the above mentioned movable frame (also called sub-frame) carrying the anodes, is connected to the lever arms by means of four hinged supports.

The shifting of the movable frame and, consequently, of the anodes can be controlled by a centralized and computerized system (which is not part of the invention) as a function of voltage and current variation measurements.

12 Claims, 5 Drawing Sheets

MOTORIZED FRAME FOR ADJUSTING THE INTERELECTRODIC GAP IN MERCURY CELLS

DESCRIPTION OF THE INVENTION

The invention relates to a method and apparatus for the protection of electrolysis cells of the mercury cathode type against internal short-circuits which may occur between the anode structure and the liquid mercury cathode (amalgam) due to variations of the amalgam level caused by the accumulation of foreign matter, especially iron particles, or deviations of the amalgam stream caused by corrosion of the cell bottom surface, or malfunction of the mercury recirculation pump.

According to the present invention, whenever the gap between the mercury cathode and the anodes is decreased below a safety limit in correspondence of any region of the active surface, and the local current intensity thereby reaches a dangerous level, an electromechanical system (motorized device) controlled by a computer processing voltage and current data is provided to carry out the automated raising of one or more anode rows. Moreover, in order to minimize the energy consumption directly related to the interelectrodic gap, the electromechanical system of the invention, controlled by a computer processing voltage and current data, will provide for lowering of one or more anode rows to restore the interelectrodic gap at a minimum pre-established safety level.

DESCRIPTION OF THE PRIOR ART

In a typical horizontal cathode mercury cell of the type illustrated, for example, in FIGS. 1 and 2, several types of anode adjusting devices have been applied in the past such as those herein described:

MULTIPLE LEVERS: this system, also called "gull wings" type, is a fully movable apparatus consisting in a rectangular frame and three double levers, one along the longitudinal axis and two along the transversal axis of the cell, each lever being equipped with two arms. In this case, the movement of the frame is a combination of the shifting of both longitudinal and transversal lever systems. Such apparatus is complex, expensive and suitable only for large-size frames supporting three or four anode rows moving all together, with a consequently low efficiency in energy saving as localized gap control is not made possible.

FOUR JACKSCREWS: this system consists in a frame equipped with four jackscrews positioned at the corners of the frame and two gear motors each driving two jackscrews. Also in this case the system, due to the cost, is conveniently applied only to large size frames bearing three or four anode rows and consequently is a low efficiency system as above explained.

TORSION BAR: this system consists in a rectangular frame with two shafts assembled under the two shorter sides. The two shafts are rotated by means of a gear motor acting, by means of a worms crew, on two arms each connected to one shaft. Having each shaft two plates welded at the ends bearing on four supporting columns, as the shafts rotate a shifting of the entire apparatus is originated. This system cannot guarantee a very precise control of the lifting velocity.

PINIONS AND CHAINS: this system comprises a frame secured to four threaded rods and vertically shifted by means of four pinions rotating thereon, all connected by a chain, one of which being powered by a gear motor. This system cannot allow the necessary precision of the movements due to the loosening and wearing of the chains in time.

OBJECTS OF THE INVENTION

It is an object of the present invention to provide a motorized device suitable for adjusting the anodes so as to prevent short-circuits in mercury cathode electrolytic cells as well as to break eventual short-circuits before damaging of the anode structures occurs.

It is another object of the invention to substantially reduce the energy consumption directly related to the extent of the interelectrodic gap, providing means for adjusting the distance of one or more anode rows from the liquid mercury cathode in order to bring the interelectrodic gap down to a minimum pre-determined safety level.

It is another object of the invention to overcome the drawbacks of the above described systems of the prior art, providing a new motorized device suitable for adjusting the anodes, having following main features and advantages:

low cost simplified and strong mechanical structure precision of shifting optimized shifting velocity easier assembly single anode row shifting It is another object of the present invention to provide a motorized device suitable for adjusting the anodes with an optimized interelectrodic gap control efficiency by means of the possibility of single anode row shifting and of the easy computer controlled operation on the basis of current and voltage measurements.

DESCRIPTION OF THE INVENTION

A typical cathode mercury cell is illustrated in FIGS. 1, 2 and 3, wherein.

DETAILED DESCRIPTION OF THE INVENTION

Figure 1:
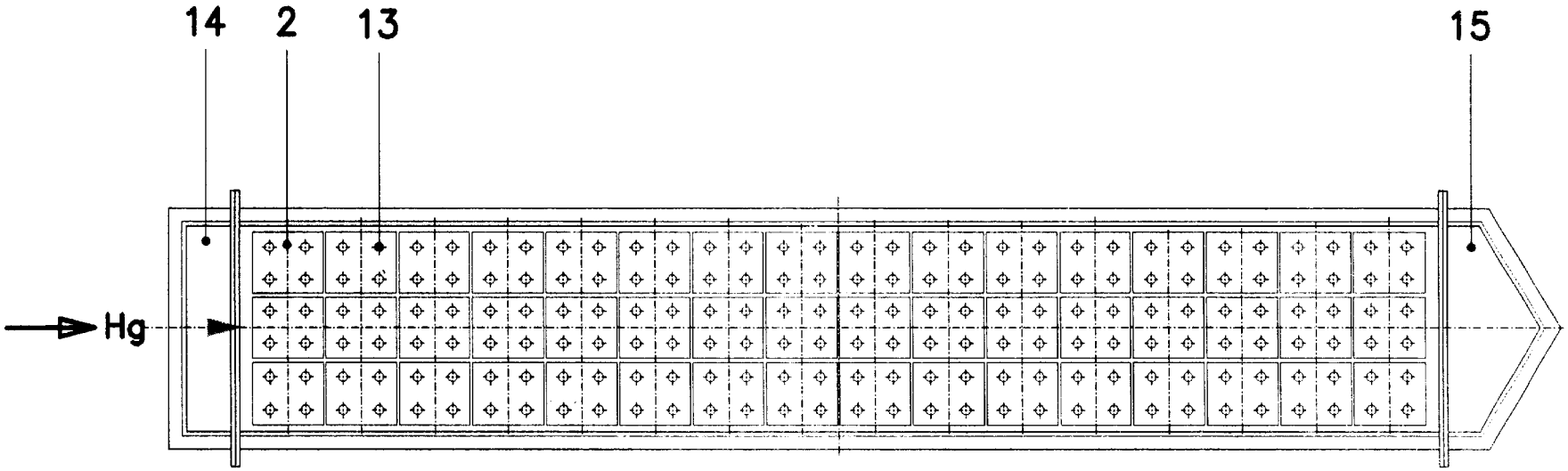
FIG. 1 is a schematic plan-view showing the anode rows arrangement.
Figure 2:
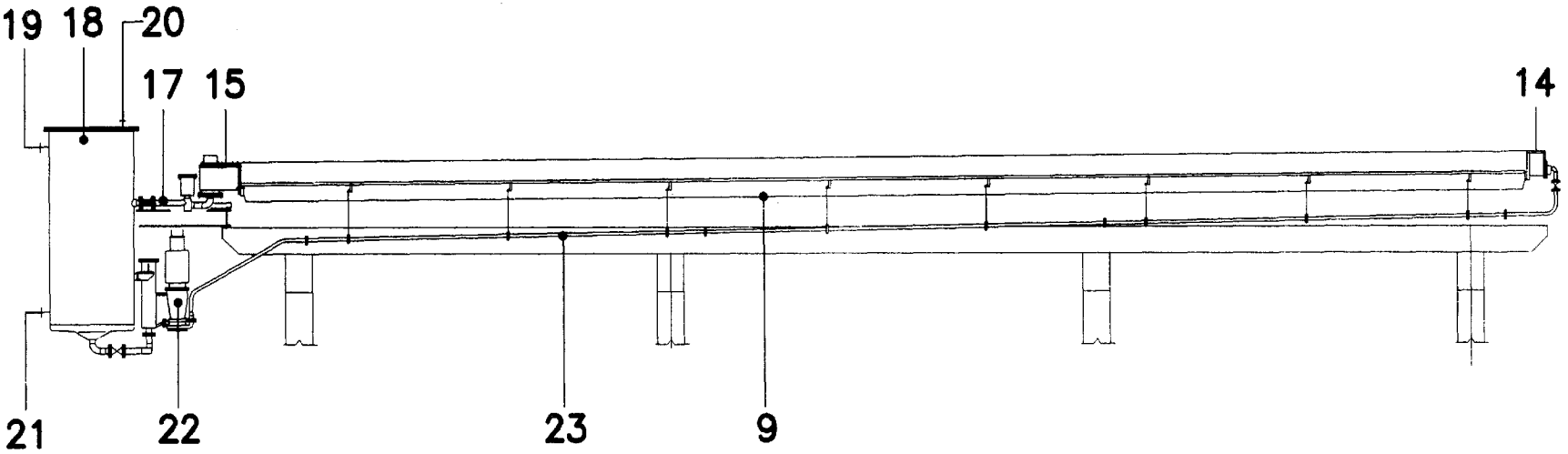
FIG. 2 is the longitudinal side-view showing the mercury recirculation route.
Figure 3:
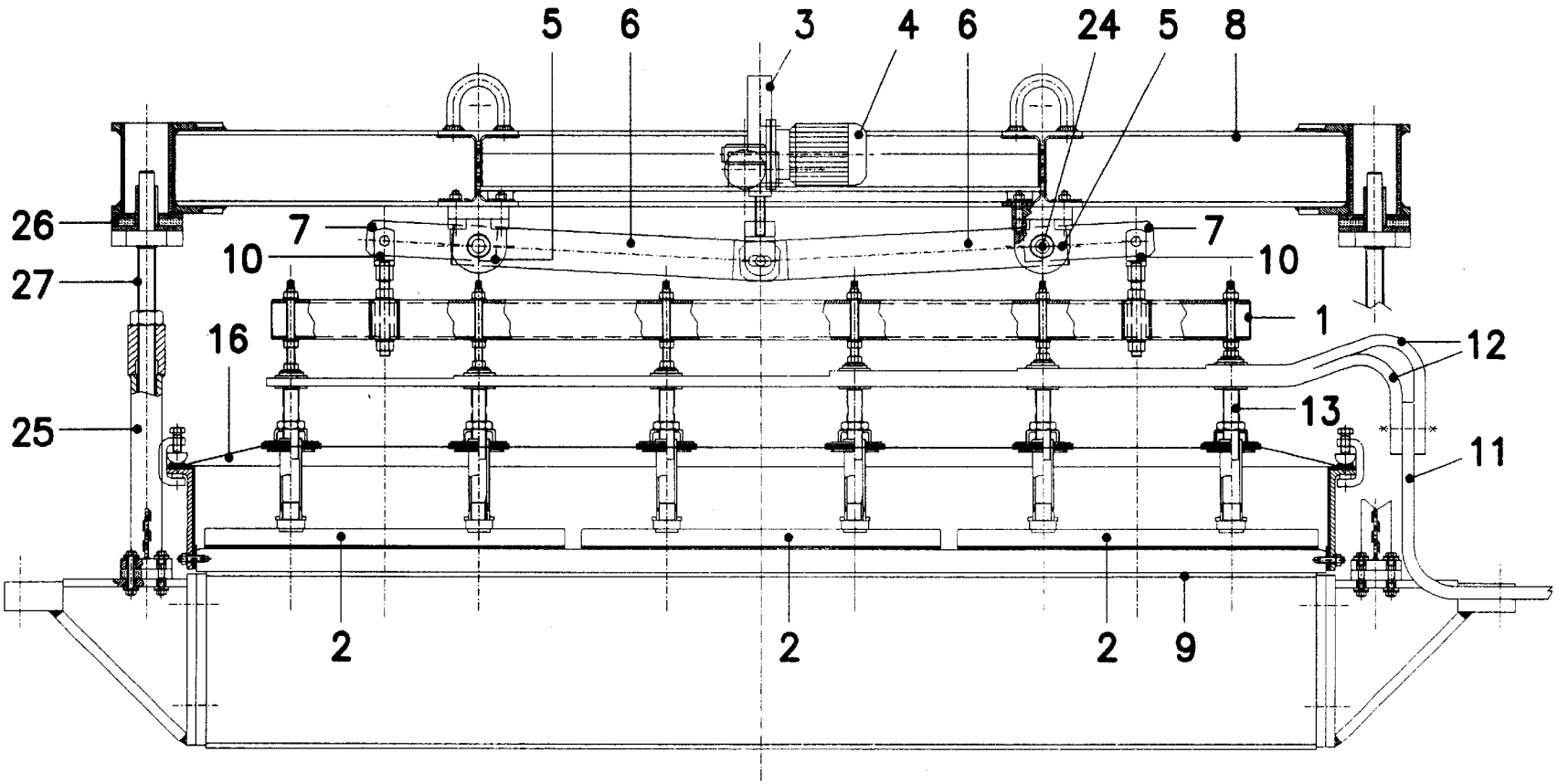
FIG. 3 is the transversal cross-section of the motorized device of the invention.

The cell is generally equipped with a multiplicity of anode rows, each consisting of one to three single anodes. FIGS. 1 and 3 show a cathode mercury cell equipped with 16 anode rows, each consisting of 3 anodes.

The current load is fed to the cell through copper bus-bar lines 11, raising from the bottom of the adjacent cell and connected to each anode row by means of copper flexibles 12, fixed to the copper stems 13 of the three anodes.

In the inlet end-box 14 the mercury, acting as the liquid cathode, is distributed over the entire width of the cell and flows over the cell bottom 9, assembled with the proper slope, toward the outlet end-box 15. At the inlet end-box also brine, for instance sodium or potassium chloride brine, is fed to the cell.

The following description makes reference to the case of sodium chloride brine electrolysis, but it is clearly to be understood that the same considerations may apply for other electrolytes, such as for instance potassium chloride brine.

In the cell, chlorine gas is produced at the anodes while the mercury-sodium amalgam is formed at the cathode. Chlorine, collected in the gas space between the brine and the flexible cell cover 16, is discharged above the brine level from the inlet end-box. The mercury-sodium amalgam, formed in the cell and collected in the outlet end- box, flows through line 17 to the decomposer 18 where the reaction between the amalgam and demineralised water, fed to the decomposer through nozzle 21, takes place, producing caustic soda and hydrogen which leave the cell separately from the top of the decomposer through nozzles 19 and 20. The mercury, stripped from sodium and collected at the decomposer bottom, is pumped back to the inlet end-box by means of pump 22 through line 23. The depleted brine, with some dissolved chlorine, leaves the cell from the outlet end-box.

FIG. 3 shows a detailed transversal cross-section of the above described cathode mercury cell wherein an embodiment of the a motorized device of the invention is represented.

Figure 4:
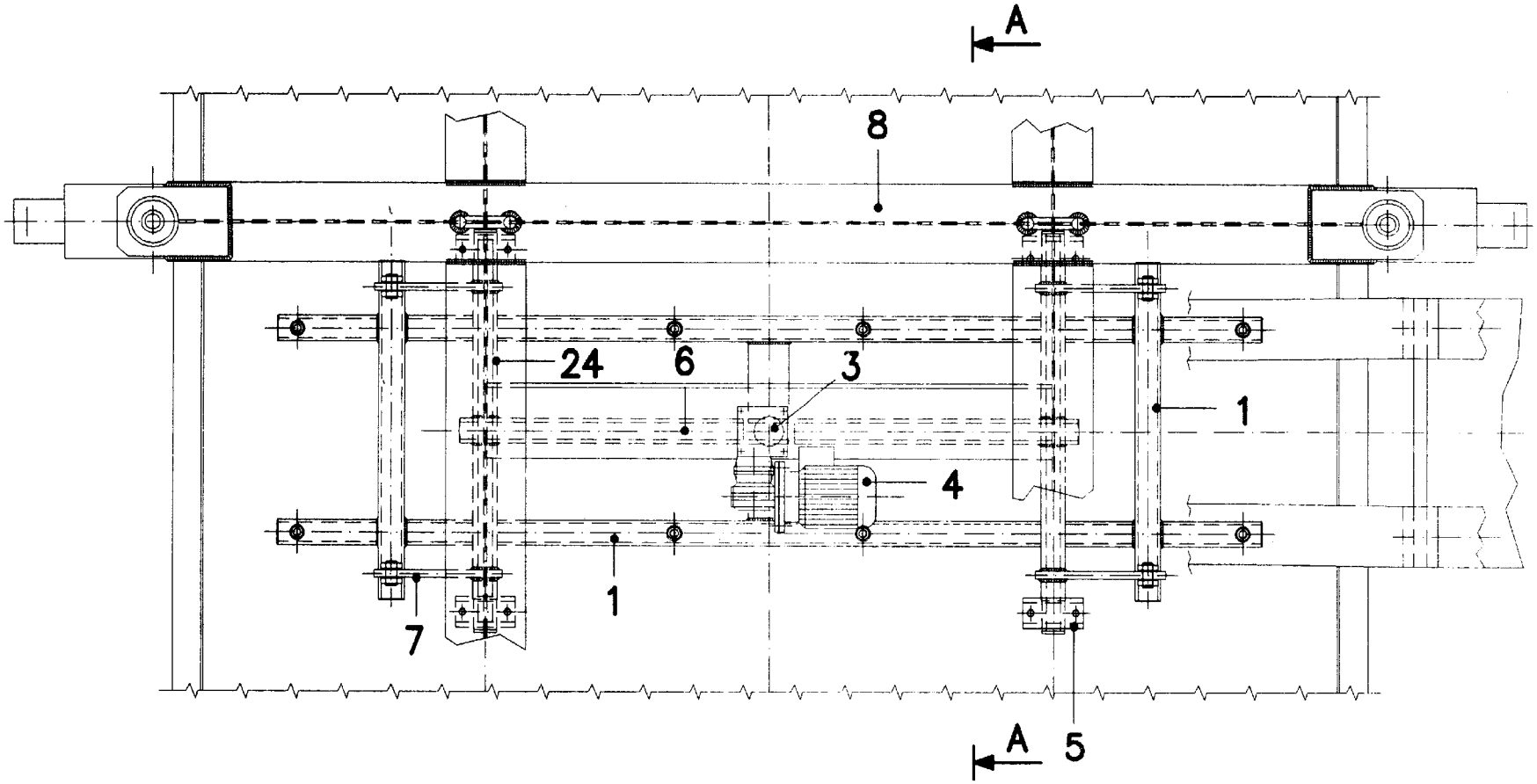

FIG. 4 shows the plan-view of the embodiment of FIG. 3.

Figure 5:
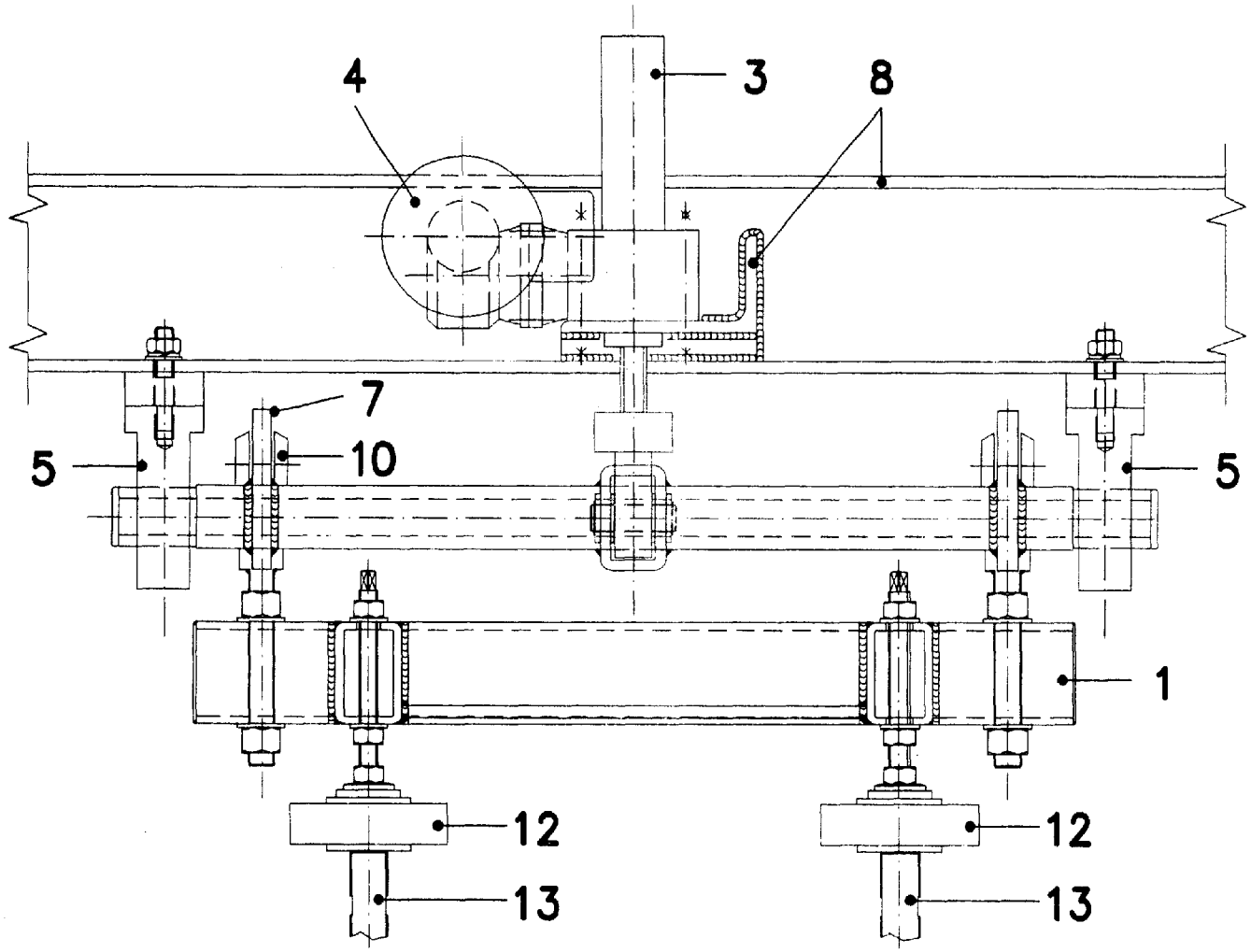

FIG. 5 represents the cross-section A—A of FIG. 4 showing additional details.

FIGS. 3, 4 and 5 show the anode adjusting device as essentially consisting of two parts:

The first part, fixed to the main frame 8, comprises the lever system composed of support bearings 5, lever arms 6 and 7 and two shafts 24, as well as the jackscrew 3 and the gear motor 4. The main frame 8 is supported on cell bottom 9 by means of columns 25 including the plates 26 which insulate the main frame from the cell bottom, also equipped with threaded rods 27 in order to adjust the level of the main frame.

The second part is composed of the movable frame (or sub-frame) 1 carrying the three anodes 2 of one single row.

The two parts are connected by the four hinges 10 each consisting in a fork with a threaded rod and two nuts, in order to have adjustable connections in the vertical direction to the sub-frame 1 which is provided with holes bigger than the threaded rods of the hinges 10, so as to allow the regulation also in the horizontal direction.

The components of the system (main frame, levers, sub-frame) can be made of carbon steel, protected with epoxy paint, except for the threaded parts which can be provided with a galvanic coating and protected with grease.

The above components can be manufactured using standard profiles and shapes, while gear motors, jackscrews, support bearings and hinges are commercially available. This allows the low cost production of the motorized frame of the present invention.

The functioning of the motorized device of the invention may be summarized as follows.

When the centralized control system sends the input to rise or lower the anodes of one row, the motor 4 is actuated and acts on the jackscrew 3 through the gearbox. The jackscrew shifts the two longer arms of levers 6, connected by a joint to the threaded bar of the jackscrew, in the vertical direction. Each lever 6 is welded to one of the two shafts 24, fixed to the main frame by means of two support bearings 5. Each shaft 24 together with the two support bearings 5 thus becomes one of the two fulcra of the double lever system.

The rotation of the two lever arms 6 and, consequently, of the two shafts 24, allows the rotation of the four shorter lever arms 7 which raise or lower the sub-frame 1 to which the anodes are suspended. The ratio between the shifting up or down of the jackscrew threaded bar and that of the anodes is determined by the ratio between the lengths of the longer lever arms 6 and the shorter lever arms 7. This ratio is preferably 3/1 to 4/1.

The raising or lowering movement depends from the direction of rotation of the motor, established by the centralized control system. The instantaneous shifting speed is constant, depending from the rotation speed of the motor and from the gear ratio, while the total shifting is a function of the frequency of the impulses given by the control centralized control to the motor. The instantaneous shifting speed of the sub-frame 1 (i.e. of the anodes) can advantageously range from 0.3 mm/s to 0.6 mm/s. The total shifting of the anodes preferably ranges from 30 to 50 mm.

The specific embodiments hereinbefore described have the sole scope of illustrating the invention and are not intended to limit its extent, which is exclusively defined by the appended claims.

Throughout the description and claims of the specification the word "comprise" and variation of the word, such as "comprising" and "comprises" is not intended to exclude other additives, components, integers or steps.

What is claimed is:

1. A motorized device for adjusting the interelectrodic gap in mercury cathode electrolysis cells, comprising at least one sub-frame, from which at least one anode is suspended, movable in the vertical direction by a single jackscrew driven by at least one gear motor acting on a double lever system, said jackscrew with said at least one gear motor being fixed to a main frame supported on the cell bottom, said double lever system being secured to a pair of shafts fixed to the main frame by support bearings, said sub-frame being connected to the arms of said lever system by hinged supports.

2. A motorized device for adjusting the interelectrodic gap in mercury cathode electrolysis cells, comprising at least one sub-frame from which at least one anode is suspended, movable in the vertical direction by a single jackscrew driven by at least one gear motor acting on a double lever system, said jackscrew with said at least one gear motor being fixed to a main frame supported on the cell bottom, said double lever system being secured to a pair of shafts fixed to the main frame by support bearings, said sub-frame being connected to the arms of said lever system by hinged supports, said double lever system comprises two longer lever arms and four shorter lever arms, and the ratio of said longer lever arms to said shorter lever arms is comprised between 3/1 to 4/1.

3. The motorized device of claim 2 wherein said main frame is supported on said cell bottom by means of columns provided with plates electrically insulating said main frame from said cell bottom.

4. The motorized device of claim 2 wherein said at least one anode is a single row of anodes.

5. The motorized device of claim 1 wherein said main frame is supported on said cell bottom by means of columns provided with plates electrically insulating said main frame from said cell bottom.

6. The motorized device of claim 1 wherein said at least one anode is a single row of anodes.

7. The motorized device of claim 1 wherein said gear motor is connected to a centralized control system which actuates said gear motor to prevent or break short-circuits.

8. The motorized device of claim 1 wherein said gear motor is connected to a centralized control system which actuates said gear motor to minimize the electrodic gap and reduce the energy consumption.

9. A method for adjusting the interelectrodic gap in a mercury cathode electrolysis cell comprising actuating the motorized device of claim 1 by means of a centralized control system and shifting the anodes in the vertical direction.

10. The method of claim 9 wherein said shifting of the anodes has a speed comprised between 0.3 and 0.6 mm/s.

11. The method of claim 10 wherein the shifting of said anodes is comprised between 30 to 50 mm.

12. The method of claim 9 wherein the shifting of said anodes is comprised between 30 to 50 mm.

* * * * *